United States Patent [19]

Nishimura

[11] Patent Number: 4,854,890

[45] Date of Patent: Aug. 8, 1989

[54] SHIELDED ELECTRICAL CONNECTOR

[75] Inventor: Ryoji Nishimura, Machida, Japan

[73] Assignee: AMP Incorporated, Harrisburg, Pa.

[21] Appl. No.: 208,603

[22] Filed: Jun. 15, 1988

[30] Foreign Application Priority Data

Jul. 13, 1987 [JP] Japan ..... 62-174597

[51] Int. Cl.[4] ..... H01R 13/648

[52] U.S. Cl. ..... 439/607; 439/736; 29/883

[58] Field of Search ..... 439/92, 95, 101, 108, 439/607, 609, 610, 736; 29/883, 884

[56] References Cited

U.S. PATENT DOCUMENTS 4,512,618 4/1985 Kumar ..... 439/607

4,521,062 6/1985 Kurbikoff et al. ..... 439/607

OTHER PUBLICATIONS

AMP Catalog 79-547, Aug. 1988, "Subminiature D Pin and Socket Connectors per MIL-C-24308 (Amplimite)".

*Primary Examiner*—Neil Abrams

*Assistant Examiner*—Khiem Nguyen

*Attorney, Agent, or Firm*—Adrian J. LaRue; William B. Noll; Bruce J. Wolstoncroft

[57] ABSTRACT

A male shielded electrical connector comprises a metal frame member (3, 30, 300) and a dielectric housing member (6, 60, 600) molded to the metal frame member forming a unitary housing with metal section (5, 50, 500) and a section of housing member (6, 60, 600) forming a male connecting section (4, 40, 400) having a smooth continous exterior surface (4'', 40'', 400'') part of which is metal and the other part is dielectric material.

8 Claims, 3 Drawing Sheets

SHIELDED ELECTRICAL CONNECTOR

FIELD OF USE

This invention relates to an electrical connector which electrically connects circuits or machines. It also refers to an improved shielded electrical connector which is shaped so that the part which joins matable connectors after they have been connected is shielded.

BACKGROUND OF THE INVENTION

Connectors are used as a means of electrically connecting and disconnecting circuits or machines. Shielded connectors are used to shield the electrical signal contacts of matable connectors to isolate the signal contacts from exterior interference.

When the male connecting section, which protrudes from the metal shield member of the connector, is inserted into the female connecting section of another connector which protrudes from the metal shield member thereof, the metal shield members electrically engage each other. The result is a shielded connector which is constructed so that the connected parts are enclosed by a metal shield.

The connecting part of the male connector is in the form of a dielectric section of the dielectric housing having holes in which contact sections of electrical contacts are located. The male connecting part is covered by a section of the metal shield member. When the male connector is connected to the female connector, the metal-covered male connecting section is inserted into the female metal connecting section of the female connector and the electrical contacts of the connectors are electrically engaged. The metal shields of both connectors also make electrical contact with each other thereby shielding the electrically-connected contacts.

The metal shield member of the female connector is usually stamped and formed so that it fits onto the dielectric housing of the connector. On the other hand, the connecting section of the male connector is configured as described above which leaves very little space between the dielectric housing and the metal shield thereover. The connecting section of the male connector is to be inserted into the metal female connecting section of the female connector. If the dielectric part of the male connecting section is to be molded in a metal frame, which is die cast so that it fits into the mold, it is difficult to mold plastic by flowing it into the enclosed section of the metal frame and form the holes in which the electrical contacts are to be positioned to the outer end of the male connecting part because the walls formed in the plastic between the holes and the enclosed metal section are very thin.

In the aforementioned male connector, a metal shield which has been cast or stamped and formed, is mounted on the dielectric housing and includes a section covering the contact-carrying section of the housing defining a male connecting part. This is the main reason for the high cost of the connector. In addition, a slight amount of play between the male connecting section formed from the dielectric housing and the metal shield enclosing it is inevitable. This is a reason for its low product reliability.

SUMMARY OF THE INVENTION

The present invention has the following objectives: to provide a shielded connector with improved product reliability, elimination of the need for attaching a metal shield onto the housing after the dielectric housing has been formed, elimination of a separate metal shield entirely thereby reducing the number of parts required, elimination of assembling shield to housing operations thereby lowering of manufacturing cost, and eliminating the play previously mentioned.

The shielded connector of this invention has the following features: it is made of a dielectric housing molded to a metal frame and having a connecting section of part metal and part dielectric material which is connected to another connector by inserting it into the metal shield member of the other connector which protrudes from the shield member. The shield member is die cast; the male connecting section includes a section of the dielectric housing; the connecting section is die cast and has molded thereto the housing so that it shields the connecting sections of both connectors along with the metal shields of the mated connectors.

Once the entire area around the connecting section has been enclosed by a metal section, very little space remains between the enclosed metal section and the passages in the dielectric-housing for the electrical contacts. As a result, it is difficult to form the dielectric housing by flowing it during molding into this small space. Therefore, the connector of this invention is constructed so that only a narrow metal section of the metal shield is molded to the dielectric housing and only a portion of the area around the male connecting part is covered with metal. This enables the dielectric material of the housing to flow into the narrow space mentioned above. The male connecting section can therefore be formed by molding the dielectric housing to the shield member thereby forming a unitary shielded housing and eliminating the aforementioned play from the male connector.

The area around the male connecting section is made of metal and dielectric material thereby producing a mosaic effect. As a result, the metal shields of both connectors engage each other when electrically connected. The connectors are shielded even though the area around the male connecting section is partly covered by a metal section of the shield which has been specially formed. Thus, in the case of the male connector, the need for a separate metal shield that is mounted on the dielectric housing is eliminated.

BRIEF DESCRIPTION OF THE DRAWINGS

The invention, together with objects and advantages thereof, is best understood by way of example with reference to the following detailed description in conjunction with the accompanying drawings.

DETAILED DESCRIPTION OF THE INVENTION

Figure 1:
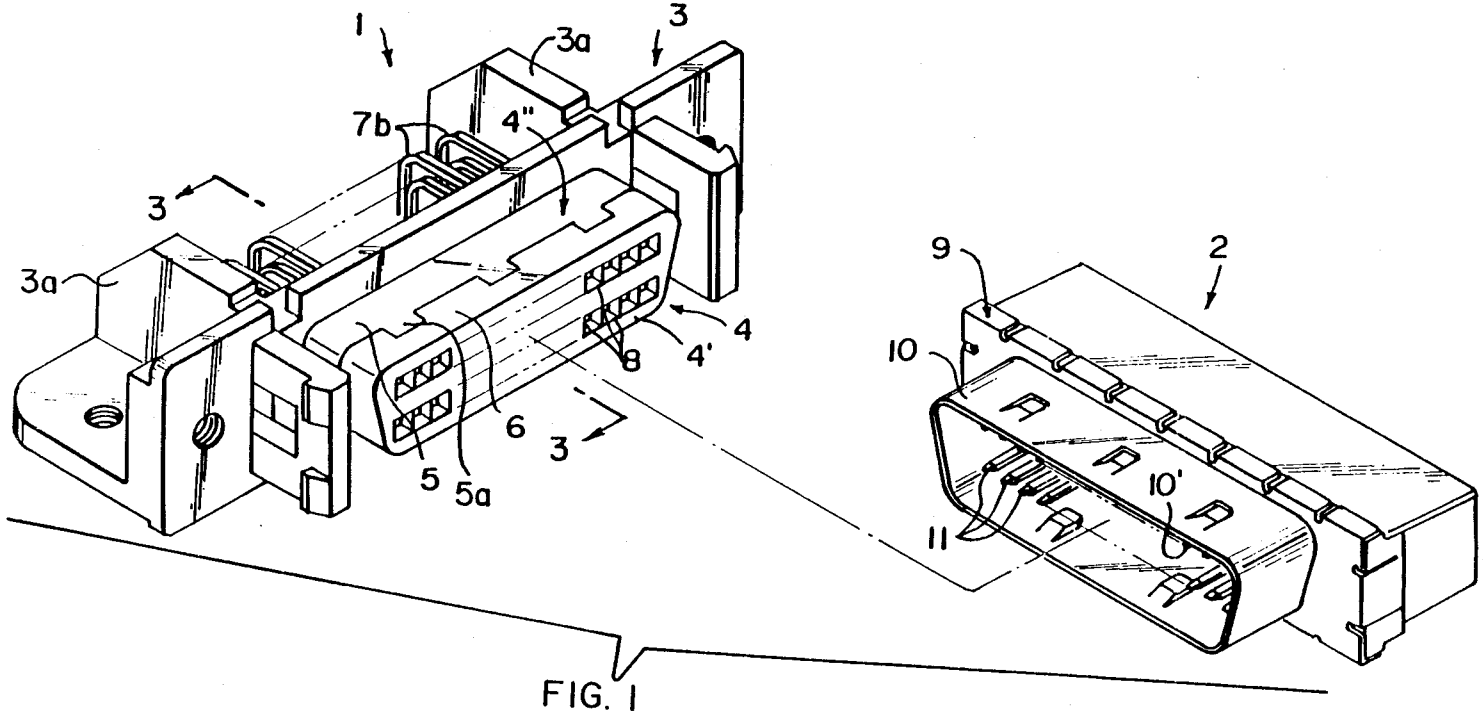
FIG. 1 is a perspective view of an example of a shielded male electrical connector of the present invention and a shielded female electrical connector exploded therefrom which is to be electrically connected to the male connector.
Figure 2:
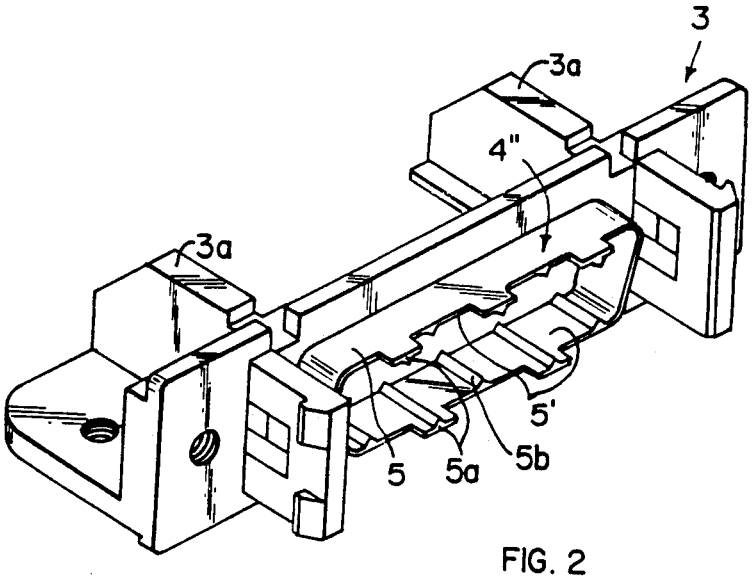
FIG. 2 is perspective view which illustrates the metal frame of the shielded male connector of FIG. 1 which has been die cast.
Figure 3:
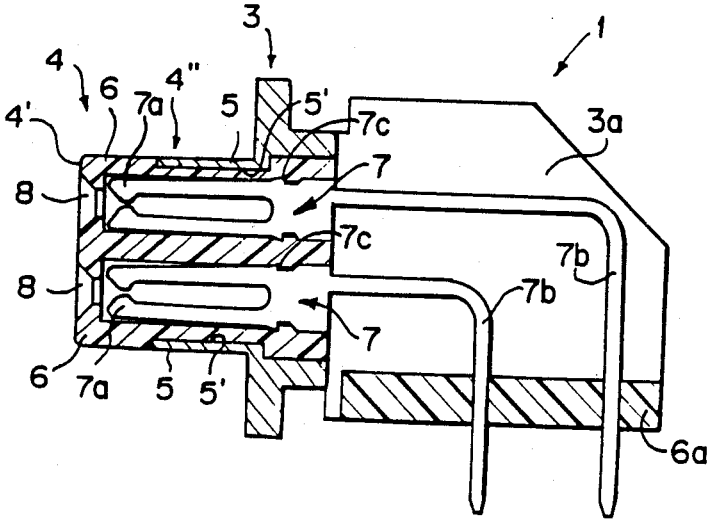
FIG. 3 is a cross-section along line 3—3 of FIG. 1.

Male electrical connector 1, as shown in FIGS. 1–3, has a metal frame 3 and a dielectric housing 6 as a unitary shielded housing. Male connecting section 4 of connector 1 protrudes from a front surface of frame 3 and includes metal section 5 of frame 3 and a front section of dielectric housing 6.

Passages 8 extend through dielectric housing 6 from front surface 4' of male connecting section 4 to the back surface thereof. Bifurcated contact sections *7a* of electrical contacts 7 are secured in respective passages 8 via barbs *7c* and they have post sections *7b* extending outwardly from the back surface of housing 6 and through holes in dielectric spacer *6a* extending between rearwardly extending walls *3a* of frame 3.

As shown in FIGS. 1 and 3, an inner part of the exterior surface 4'' of connecting section 4 of connector 1 is metal section 5 and the outer part thereof is an outer section of housing 6.

Thus, the exterior surfaces of metal section 5 and the outer section of housing 6 form the exterior surface 4'' of male connecting section 4 as a continous and smooth surface therearound.

Female electrical connector 2, as shown in FIG. 1, comprises a metal frame 9 which has a hollow metal female connecting section 10 extending forward from frame 9. Electrical pins 11 are secured in a dielectric housing (not shown) to which frame 9 is mounted and the contact sections of pins 11 are disposed within connecting section 10. Pins 11 are electrically connected with respective contact sections *7a* of electrical contacts 7 and male connecting section 4 is disposed in female connecting section 10 so as to be electrically connected therebetween when connectors 1 and 2 are electrically connected together via inner surface 10' of section 10 in engagement with the exterior surface 4'' of section 5. Metal section 5 and metal connecting section 10 thereby form a shield around the electrically-connected contacts 7 and pins 11. Connecting sections 4, 10 are profiled so as to be mated together.

To make male connector 1, frame 3 is die cast from a suitable metal, and, as shown in FIG. 2, connecting section 5 has forwardly-directed projections *5a* and spaced triangular-shaped projections *5b* along interior surface 5' of section 5. Frame 3 is positioned in a mold and then dielectric material is injected into the mold forming housing 6. Metal frame 3 with housing 6 molded thereto forms a unitary shielded housing, and after contacts 7 are secured in passages 8, shielded male electrical connector 1 is formed with male connecting section 4 with part of its exterior surface being metal while the other part of the exterior surface is dielectric material.

As can be discerned, dielectric material can flow along section 5 of frame 3 forming housing 6 so that the thickness of the wall between the inside surface 5' of section 5 and passages 8 is thin and is thicker from section 5 to front surface 4' of housing 6. If section 5 extended to front surface 4' of connecting section 4, it would be difficult to flow the dielectric material to the front surface because of the thin walls along passages 8 that would have to be formed between the inside surface 5' of section 5 and the front surface 4'.

Figure 4:
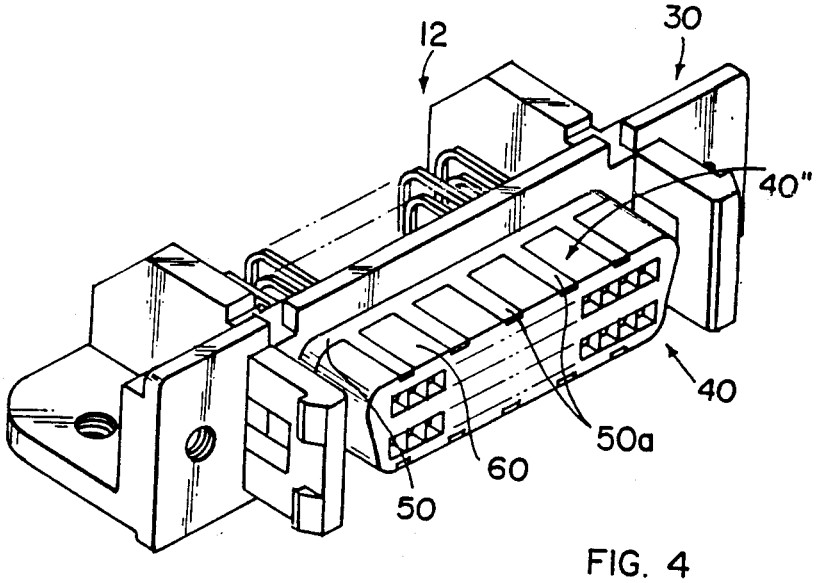
FIG. 4 is perspective view of an alternative embodiment of the shielded male connector.

FIG. 4 discloses an alternative shielded male connector 12 which is the same as that of connector 1 of FIGS. 1–3 except that metal section 50 of metal frame 30, which is part of male connecting section 40, is not as wide as metal section 5 and spaced projections *50a* of section 50 extend to the front surface of connecting section 40 with sections of housing 60 disposed therebetween so that the outer surface 40'' of connecting section 40 including the surfaces of metal section 50, projections *50a* and the exposed sections of housing 60 between projections *50a* is continuous and smooth.

Figure 5:
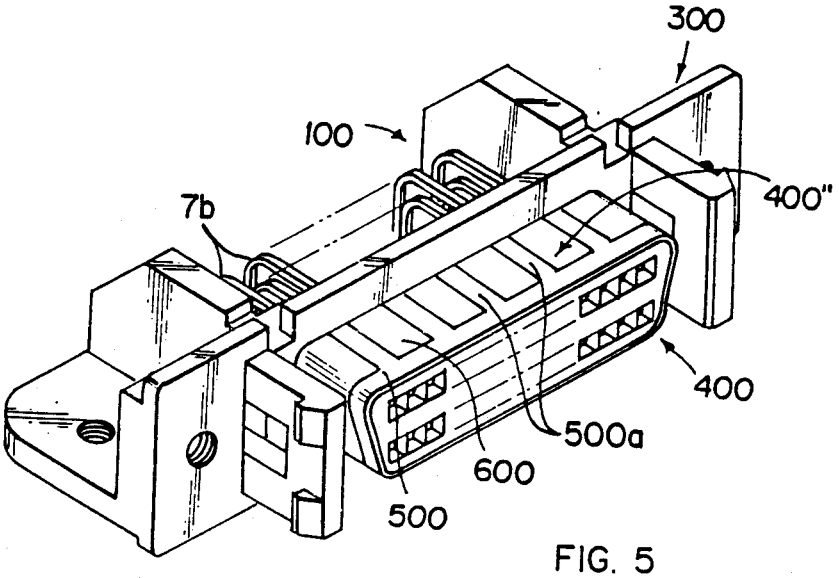
FIG. 5 is a perspective view of another embodiment of the shielded male connector.

The same is true of connector 100 of FIG. 5 wherein continuous metal section 500 is positioned along the front end of male connecting section 400 with exposed sections of dielectric housing 600 being disposed between projections *500a* that connect metal section 500 to frame 300 so that the exterior surface 400'' of male connecting section 400 is continuous and smooth.

The metal section of the die cast frame covers only a portion of the surface of the male connecting section. When the dielectric material is being molded to the metal frame, it is shaped so that it flows into the narrow space inside the metal section. It does not matter what shape it takes as long as it is shaped so that the connecting sections connecting both connectors is shielded along with the metal frames thereof when the connecting sections have been connected.

The metal frame of the shielded connector of this invention is preferably die cast. A section of the metal frame is formed so as to be used in the mold for molding the dielectric housing including the male connecting section which has a continuous and smooth exterior surface formed of part metal and part dielectric material as a mosaic of metal and dielectric material. As a result, a metal shield need not be attached to the housing so as to provide a shield section around the male connecting section after separate molding of the housing has taken place. The number of parts used is reduced, operations for attaching the metal shield are no longer required and manufacturing costs are reduced. In addition, there is no play between the metal shield and the dielectric housing and product reliabily has been improved.

I claim:

1. A shielded electrical connector, comprising:

a metal frame member having an opening extending therethrough and metal section means extending outwardly from a front surface of said metal frame member delimiting said opening;

a dielectric housing molded to said metal frame member and having a contact-receiving section within said opening and extending along said metal section means so that said metal section means and said contact-receiving section define a profiled connecting section having a smooth and continuous exterior surface part of which is formed by said metal section means and the other part is formed by said contact-receiving section.

2. A shielded electrical connector as claimed in claim 1, wherein said metal section means has a continuous section that extends along an inner part of said connecting section as an integral part of said metal frame member and includes spaced projections while the exposed part of said contact-receiving section has a continuous section that extends along an outer part of said connecting section and includes sections between said spaced projections.

3. A shielded electrical connector as claimed in claim 1, wherein said metal section means has a continuous section that extends along an inner part of said connecting section as an integral part of said metal frame member and includes spaced projections extending to a front surface of said connecting section while the exposed part of said contact-receiving section extends from said continuous section to the front surface of said connecting section between the spaced projections.

4. A shielded electrical connector as claimed in claim 1, wherein said metal section means has a continuous section that extends along an outer part of said connecting section and is connected to said metal frame member via spaced projections while the exposed part of said contact-receiving section extends from the front surface of said connecting section to the metal frame member and includes sections between said spaced projections.

5. A method of making a unitary shielded electrical connector, comprising the steps of:

placing a metal frame member into a mold, said metal frame member having an opening and metal section means extending outwardly from a front surface of said metal frame member delimiting said opening;

injecting dielectric material into said mold thereby forming a dielectric housing molded to said metal frame member with a contact-receiving section extending along said metal section means so that said metal section means forms a profiled connecting section having a smooth and continuous exterior surface defining a mosaic of metal and dielectric material.

6. A method as claimed in claim 5, wherein said metal section means has a continuous section that extends along an inner part of said connecting section as an integral part of said metal frame member and includes spaced projections while the exposed part of said contact-receiving section has a continuous section that extends along an outer part of said connecting section and sections between said spaced projections.

7. A method as claimed in claim 5, wherein said metal section means has a continuous section that extends along an inner part of said connecting section as an integral part of said metal frame member and includes spaced projections extending to a front surface of said connecting section while the exposed part of said contact-receiving section extends from said continuous section to the front surface of said connecting section between the spaced projections.

8. A method as claimed in claim 5, wherein said metal section means has a continuous section that extends along an outer part of said connecting section and is connected to said metal frame member via spaced projections while the exposed part of said contact-receiving section extends from the front surface of said connecting section to the metal frame member and includes sections between said spaced projections.

* * * * *